US006331096B1

(12) United States Patent
Burdgick et al.

(10) Patent No.: US 6,331,096 B1
(45) Date of Patent: Dec. 18, 2001

(54) APPARATUS AND METHODS FOR IMPINGEMENT COOLING OF AN UNDERCUT REGION ADJACENT A SIDE WALL OF A TURBINE NOZZLE SEGMENT

(75) Inventors: Steven Sebastian Burdgick, Schenectady, NY (US); Gary Michael Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/543,457

(22) Filed: Apr. 5, 2000

(51) Int. Cl.[7] ..... F01D 25/08
(52) U.S. Cl. ..... 415/115; 415/116; 415/176
(58) Field of Search ..... 415/116, 115, 415/176, 178, 96 R

(56) References Cited

U.S. PATENT DOCUMENTS 4,317,646 * 3/1982 Steel et al. ..... 415/116
5,169,287 * 12/1992 Proctor et al. ..... 415/115
5,823,741 * 10/1998 Predmore et al. ..... 415/134
6,126,389 * 10/2000 Burdgick ..... 415/115
6,139,257 * 10/2000 Proctor et al. ..... 415/115
6,224,329 * 4/2001 North ..... 415/116

* cited by examiner

*Primary Examiner*—Edward K. Look
*Assistant Examiner*—James M McAleenan
(74) *Attorney, Agent, or Firm*—Nixon & Vanderhye

(57) ABSTRACT

A gas turbine nozzle segment has outer and inner bands. Each band includes a side wall, a cover and an impingement plate between the cover and nozzle wall defining two cavities on opposite sides of the impingement plate. Cooling steam is supplied to one cavity for flow through apertures of the impingement plate to cool the nozzle wall. The side wall of the band and inturned flange define with the nozzle wall an undercut region. The inturned flange has a plurality of apertures for directing cooling steam to cool the side wall between adjacent nozzle segments.

13 Claims, 2 Drawing Sheets

APPARATUS AND METHODS FOR IMPINGEMENT COOLING OF AN UNDERCUT REGION ADJACENT A SIDE WALL OF A TURBINE NOZZLE SEGMENT

This Invention was made with Government support under Contract No. DE-FC21-95MC31176 awarded by the Department of Energy. The Government has certain rights in this invention.

BACKGROUND OF THE INVENTION

The present invention relates to impingement cooling of a gas turbine nozzle band undercut region and particularly relates to impingement cooling of the nozzle band edge in a design where the weld joint between the nozzle segment cover and the nozzle wall is remote from the nozzle wall exposed to the hot gas path.

In current gas turbine designs, nozzle segments are typically arranged in an annular array about the rotary axis of the turbine. The array of segments forms outer and inner annular bands and a plurality of vanes extend between the bands. The bands and vanes define in part the hot gas path through the gas turbine. Each nozzle segment comprises an outer band portion and an inner band portion and one or more nozzle vanes extend between the outer and inner band portions. In current gas turbine designs, a cooling medium, for example, steam, is supplied to each of the nozzle segments. To accommodate the steam cooling, each band portion includes a nozzle wall in part defining the hot gas path through the turbine, a cover radially spaced from the nozzle wall defining a chamber therewith and an impingement plate disposed in the chamber. The impingement plate defines with the cover a first cavity on one side thereof for receiving cooling steam from a cooling steam inlet. The impingement plate also defines, along an opposite side thereof and with the nozzle wall, a second cavity. The impingement plate has a plurality of apertures for flowing the cooling steam from the first cavity into the second cavity for impingement cooling the nozzle wall. The cooling steam then flows radially inwardly through cavities in the vane(s), certain of which include inserts with apertures for impingement cooling the side walls of the vane. The cooling steam then enters a chamber in the inner band portion and reverses its flow direction for flow radially outwardly through an impingement plate for impingement cooling the nozzle wall of the inner band. The spent cooling medium flows back through a cavity in the vane to an exhaust port of the nozzle segment.

The cover provided each of the outer and inner band portions is preferably welded to the corresponding nozzle wall. In prior designs, the weld joint between the cover and the nozzle wall was disposed at a radial location between the nozzle wall and the spline seal between side walls of adjacent nozzle segments. In that location, the weld was exposed to the high temperature gases in the hot gas flow path and was very difficult to cool. Thus, weld joint fatigue life was significantly reduced due to its proximity to the hot gas path. Moreover, the location of the weld was not optimum for manufacturing repeatability and was very sensitive to manufacturing tolerances. The weld joint was characterized by variable wall thicknesses which increased the stress at the joint, decreased the low cycle fatigue and limited the life of the parts. The wall thickness at the weld after machining was also a variable which could not be tolerated in the manufacturing process.

BRIEF SUMMARY OF THE INVENTION

In accordance with a preferred embodiment of the present invention, a cooling system is provided in a nozzle segment design in which the weld joint between the cover and nozzle wall is on the side of the spline seal remote from the nozzle wall exposed to the hot gas path. That is, the weld joint between the cover and the nozzle wall of the outer band is located radially outwardly of the spline seal between adjacent outer bands while the weld joint between the cover and the nozzle wall of the inner band is located radially inwardly of the spline seal between adjacent inner bands. This reduces the temperature of the weld joints during turbine operation, reduces the stresses across the joints, both thermal and mechanical, eliminates any requirement for machining after welding and results in joints of constant thickness and higher fatigue life. The location also leads to improved machinability and tolerance to weld defects.

To provide that weld location, undercut regions adjacent the side walls of the nozzle segment bands are formed. Particularly, each undercut region includes a side wall or edge of the nozzle segment and an inturned flange extending inwardly from and generally parallel to the nozzle wall and spaced from the nozzle wall. Cooling the nozzle band side wall or edge, however, is quite difficult in view of the undercut region which spaces the side wall or edge a substantial distance from the impingement plate which, in turn, reduces the effectiveness of impingement cooling the segment side wall.

In accordance with the present invention, improved side wall fabrication and cooling is provided. Particularly, with the weld joint between the cover and the nozzle wall located remotely from the hot gas path through the turbine, side wall cooling is improved by providing impingement cooling apertures directly through the inturned flanges of the side walls of the bands, e.g., through the castings forming the bands, in order to reduce the distance traveled by the cooling steam flow. Thus, after the interface for the securement of the impingement plate is machined into the nozzle side wall, impingement apertures may be formed through the inturned flange. Subsequently, the impingement plate is welded to the inturned flange to define the cavities or plenums on opposite sides of the impingement plate. Impingement cooling of the nozzle side wall and in the undercut region is thus provided by flowing the cooling medium through apertures in both the impingement plate and the inturned flange.

In a preferred embodiment according to the present invention, there is provided for use in a gas turbine, a nozzle segment having outer and inner bands and at least one vane extending between the bands, at least one of the bands including a nozzle wall defining in part a hot gas path through the turbine, a cover radially spaced from the nozzle wall defining a chamber therebetween and an impingement plate secured within the segment and disposed in the chamber to define with the cover a first cavity on one side thereof for receiving a cooling medium, the impingement plate on an opposite side thereof from the first cavity defining with the nozzle wall a second cavity, the impingement plate having a plurality of apertures therethrough for flowing the cooling medium from the first cavity into the second cavity for impingement cooling the nozzle wall, the nozzle segment including a side wall extending generally radially between the nozzle wall and the cover and having an inturned flange spaced from the nozzle wall, the inturned flange defining with the nozzle wall and the side wall an undercut region adjacent the side wall, and a plurality of apertures through the inturned flange for flowing the cooling medium from the first cavity for impingement cooling the side wall in the undercut region.

In a further preferred embodiment according to the present invention, there is provided in a gas turbine having a nozzle segment including outer and inner bands and at least one vane extending between the bands and wherein at least one of the bands includes a nozzle wall defining in part a hot gas path through the turbine, a cover radially spaced from the nozzle wall defining a chamber therebetween and an impingement plate secured within the band and disposed in the chamber to define with the cover a first cavity on one side thereof for receiving a cooling medium and a second cavity with the nozzle wall on an opposite side thereof, the impingement plate having a plurality of apertures therethrough for flowing the cooling medium from the first cavity into the second cavity for impingement cooling the nozzle wall, the nozzle segment including a side wall extending generally radially between the nozzle wall and the cover and having an inturned flange spaced from the nozzle wall with the nozzle wall and the side wall defining an undercut region adjacent the side wall, a method of cooling the side wall of the one band including flowing a cooling medium through a plurality of apertures through the inturned flange from the first cavity into the second cavity and directing the cooling medium from the first cavity for impingement cooling the side wall in the undercut region.

DETAILED DESCRIPTION OF THE INVENTION

Figure 1:
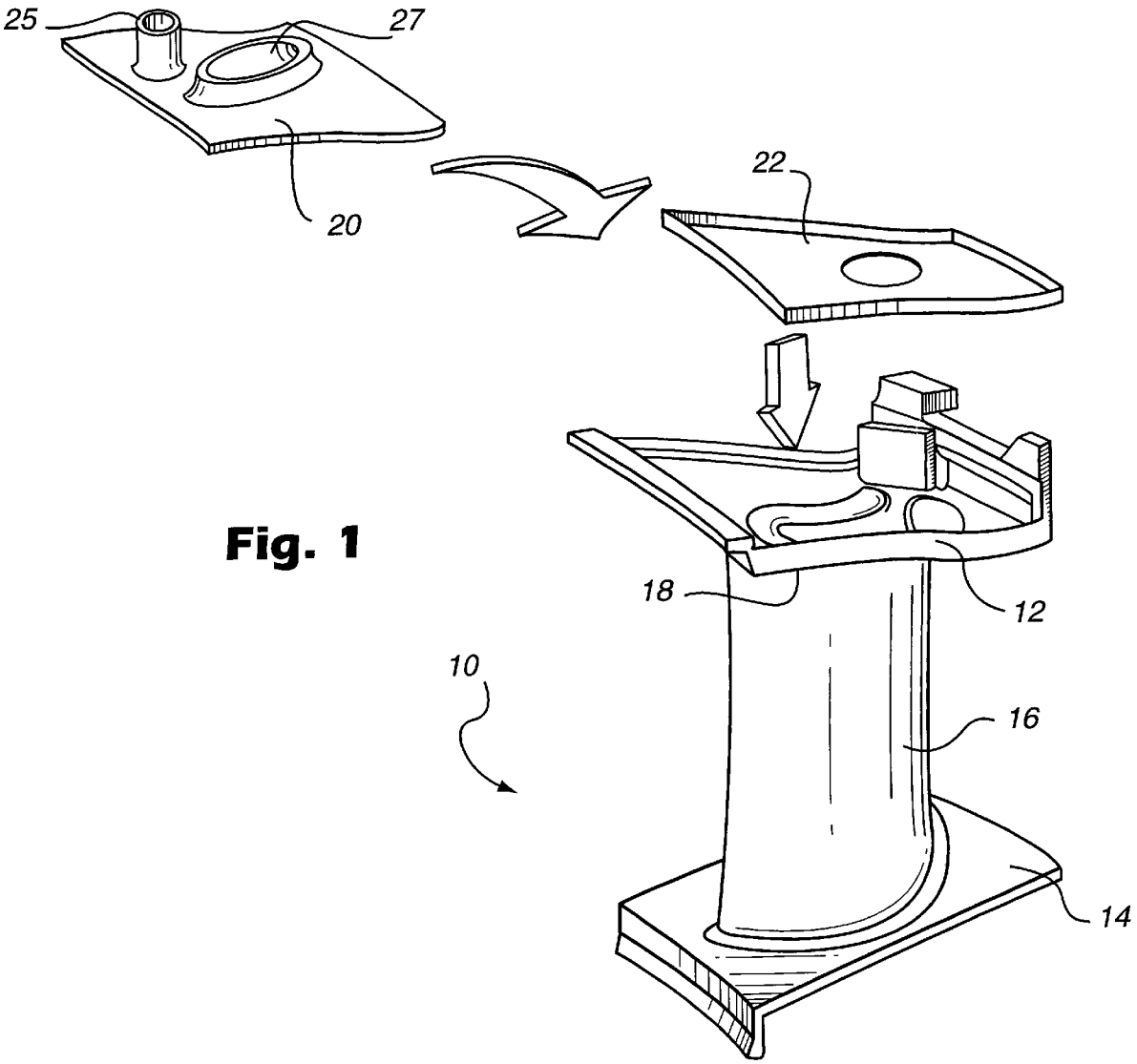
FIG. 1 is an exploded perspective and schematic view of a nozzle segment constructed in accordance with the present invention.

Referring now to FIG. 1, there is illustrated a nozzle segment, generally designated 10, forming a part of an annular array of segments disposed about a gas turbine axis. Each nozzle segment includes an outer band 12, an inner band 14 and one or more vanes 16 extending therebetween. When the nozzle segments are arranged in the annular array, the outer and inner bands 12 and 14 and vanes 16 define an annular hot gas path through the gas turbine, as is conventional.

The outer and inner bands and the vanes are cooled by flowing a cooling medium, e.g., steam, through a chamber of the outer band 12, radially inwardly through cavities in the vanes, through a chamber in the inner band 14 and radially outwardly through the vanes for return of the cooling medium to an exit port along the outer band. More particularly and by way of example in FIG. 1, the outer band 12 includes an outer nozzle wall 18, an outer cover 20 which is disposed over and welded to the outer wall 18 to define a chamber 21 (FIG. 2) therebetween and an impingement plate 22 disposed in the chamber 21. The impingement plate 22 defines with the nozzle segment cover 20 a first cavity 24 and, on an opposite side thereof, defines with the nozzle wall 12 a second cavity 26. Cooling medium inlet and outlet ports 25 and 27, respectively, are provided through the cover for supplying the cooling medium, e.g., steam, to the nozzle vane segment and exhausting the spent cooling steam from the segment. The cooling steam is supplied to the first cavity 24 for passage through a plurality of apertures 30 in the impingement plate 22 for impingement cooling of the side wall 18. The impingement cooling steam flows from the second cavity 26 into one or more inserts (not shown) in cavities extending through the vane between the outer and inner bands. The vane inserts include a plurality of apertures for impingement cooling of the side walls of the vane. The cooling steam then flows into the chamber of the inner band 14 and particularly into the radial innermost cavity for flow through apertures of an impingement plate in the inner band for impingement cooling the side wall of the inner band. The spent cooling steam then flows through a cavity in the vane and through the exhaust port of the outer band. For a complete description of an embodiment of the foregoing described cooling circuit, reference is made to U.S. Pat. No. 5,634,766, of common assignee, the disclosure of which is incorporated herein by reference.

Figure 2:
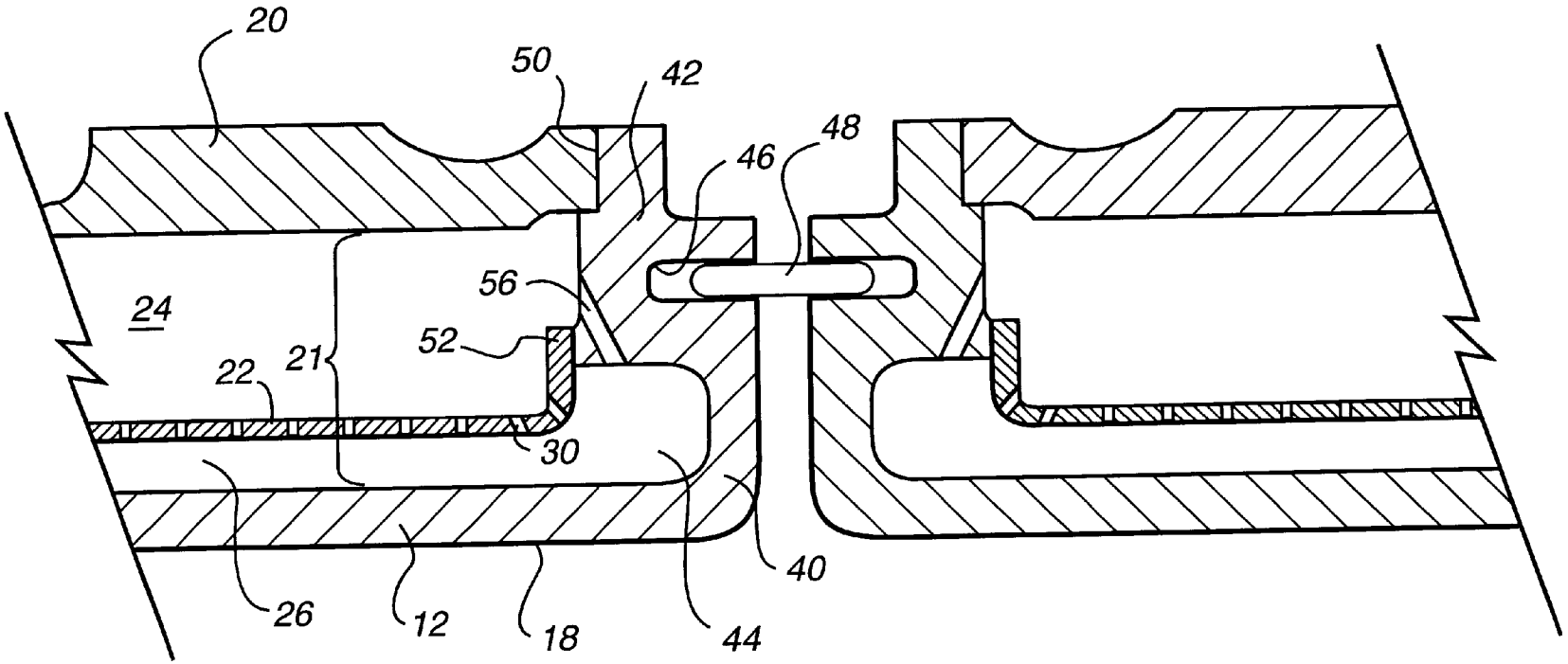
FIG. 2 is an enlarged fragmentary cross-sectional view illustrating a joint between side walls of adjacent nozzle segments further illustrating the location of the cover/nozzle casting weld joint and the impingement cooling apertures.

Referring now to FIG. 2, there is illustrated a juncture between adjacent nozzle segments. It will be appreciated that while the following description is specific with reference to the outer band 12, it is equally applicable to the inner band 14. Thus, each nozzle band (both inner and outer bands) includes a nozzle side wall or edge 40 which extends generally radially between the nozzle wall 18 and the cover 20. The band also includes an inturned flange 42 spaced from the nozzle wall 18 and defines with wall 18 and side wall or edge 40 an undercut region 44. The inturned flange 42 also includes a circumferentially opening slot 46 for receiving one edge of a spline 48 forming a seal between adjacent nozzle segments.

As illustrated in FIG. 2, the covers 20 are welded to the inturned flanges 42 along opposite edges of the nozzle band. Also, the weld joint 50 lies on the side of the spline seal 48 remote from the nozzle side wall 18. By locating the weld joint 50 away from the hot gas path defined in part by nozzle wall 18, the weld joint 50 is subjected to a much lower temperature than if located closer to the hot gas path. Also illustrated in FIG. 2 is the impingement plate 22 which has an upturned flange 52 along opposite margins for brazing or welding to an inside surface of the inturned flanges 42. While apertures 30 are located in each upturned flange 52 of the impingement plate, it will be appreciated that there is a substantial distance between the nearest aperture 30 and the side wall or edge 40 in the undercut region 44. This large distance diminishes the effectiveness of the impingement cooling.

To afford effective impingement cooling of the side wall or edge 40 along the undercut region, a plurality of apertures 56 are formed along and through the inturned flanges 42 in communication between the first and second cavities. Importantly, however, the apertures 56 are directed and have a length-to-diameter ratio to provide targeted cooling of the side wall or edge 40 by the impingement cooling steam flowing through the apertures 56. As will be appreciated, the flow distance between the apertures 56 and the side wall or edge 40 along opposite sides of the nozzle bands 12 and 14 is substantially reduced by locating the apertures 56 in the inturned flange 42. Cooling is also improved by targeting apertures 56 of a high length/width ratio for flow of the cooling steam directly onto the side walls or edges 40.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For use in a gas turbine, a nozzle segment having outer and inner bands and at least one vane extending between said bands, at least one of said bands including a nozzle wall defining in part a hot gas path through the turbine, a cover radially spaced from said nozzle wall defining a chamber therebetween and an impingement plate secured within said segment and disposed in said chamber to define with said cover a first cavity on one side thereof for receiving a cooling medium, said impingement plate on an opposite side thereof from said first cavity defining with said nozzle wall a second cavity, said impingement plate having a plurality of apertures therethrough for flowing the cooling medium from said first cavity into said second cavity for impingement cooling said nozzle wall, said nozzle segment including a side wall extending generally radially between said nozzle wall and said cover and having an inturned flange spaced from said nozzle wall, said inturned flange defining with said nozzle wall and said side wall an undercut region adjacent said side wall, and a plurality of apertures through said inturned flange for flowing the cooling medium from said first cavity for impingement cooling the side wall in the undercut region.

2. A nozzle segment according to claim 1 wherein said impingement plate has an inturned edge secured to said inturned flange of said side wall, said apertures through said impingement plate extending through said inturned edge thereof.

3. A nozzle segment according to claim 2 wherein said inturned edge of said impingement plate extends generally in a radial direction.

4. A nozzle segment according to claim 1 wherein said nozzle side wall and said cover are welded to one another at a weld joint on a side of said impingement plate remote from said nozzle wall.

5. A nozzle segment according to claim 1 wherein said side wall has a slot opening outwardly of said segment for receiving a spline seal, said side wall and said cover being welded to one another at a weld joint outwardly of said slot.

6. A nozzle segment according to claim 1 wherein said impingement plate has an inturned edge secured to said inturned flange of said side wall, said apertures through said impingement plate extending through said inturned edge thereof, said nozzle side wall and said cover being welded to one another at a weld joint on a side of said impingement plate remote from said nozzle wall.

7. A nozzle segment according to claim 6 wherein said inturned edge of said impingement plate extends generally in a radial direction.

8. A nozzle segment according to claim 6 wherein said side wall has a slot opening outwardly of said segment for receiving a spline seal, said side wall and said cover being welded to one another at a weld joint outwardly of said slot.

9. A nozzle segment according to claim 1 wherein said one band comprises an outer band of said nozzle segment.

10. A nozzle segment according to claim 1 wherein said one band comprises an inner band of said nozzle segment.

11. In a gas turbine having a nozzle segment including outer and inner bands and at least one vane extending between said bands and wherein at least one of said bands includes a nozzle wall defining in part a hot gas path through the turbine, a cover radially spaced from said nozzle wall defining a chamber therebetween and an impingement plate secured within said band and disposed in said chamber to define with said cover a first cavity on one side thereof for receiving a cooling medium and a second cavity with said nozzle wall on an opposite side thereof, said impingement plate having a plurality of apertures therethrough for flowing the cooling medium from said first cavity into said second cavity for impingement cooling said nozzle wall, said nozzle segment including a side wall extending generally radially between said nozzle wall and said cover and having an inturned flange spaced from said nozzle wall with said nozzle wall and said side wall defining an undercut region adjacent said side wall, a method of cooling the side wall of said one band including flowing a cooling medium through a plurality of apertures through said inturned flange from said first cavity into said second cavity and directing the cooling medium from said first cavity for impingement cooling the side wall in the undercut region.

12. A method according to claim 11 wherein said impingement plate has an inturned edge secured to said inturned flange of said side wall, said apertures and including flowing the cooling medium from said first cavity through said inturned edge of said impingement plate.

13. A method according to claim 12 including directing the flow of the cooling medium through the apertures of said inturned flange and said inturned edge generally laterally for direct impingement cooling the side wall of the one band.

* * * * *